US011098498B2

(12) United States Patent
Godwin

(10) Patent No.: US 11,098,498 B2
(45) Date of Patent: Aug. 24, 2021

(54) METHOD AND SYSTEM FOR ADJUSTABLE SAFETY LOCKS

(71) Applicant: Matthew Emil Godwin, Henderson, NV (US)

(72) Inventor: Matthew Emil Godwin, Henderson, NV (US)

( * ) Notice: Subject to any disclaimer, the term of this patent is extended or adjusted under 35 U.S.C. 154(b) by 0 days.

(21) Appl. No.: 15/413,160

(22) Filed: Jan. 23, 2017

(65) Prior Publication Data

US 2017/0211297 A1 Jul. 27, 2017

Related U.S. Application Data

(60) Provisional application No. 62/281,931, filed on Jan. 22, 2016.

(51) Int. Cl.

| | |
|---|---|
| ***E05B 65/08*** | (2006.01) |
| ***E05C 17/60*** | (2006.01) |
| *E05C 7/00* | (2006.01) |

(52) U.S. Cl.
CPC ..... *E05B 65/0888* (2013.01); *E05C 17/60* (2013.01); *E05C 2007/007* (2013.01)

(58) Field of Classification Search
CPC ..... E05B 65/0888; E05C 17/60
See application file for complete search history.

(56) References Cited

U.S. PATENT DOCUMENTS

| | | | | |
|---|---|---|---|---|
| 3,420,001 | A | 1/1969 | Raymon | |
| 3,698,754 | A | 10/1972 | Means | |
| 3,967,843 | A * | 7/1976 | Hart | E05B 65/0888 16/82 |
| 4,152,018 | A | 5/1979 | Cantrell | |
| 4,699,407 | A * | 10/1987 | Fortier | E05B 65/0888 292/263 |
| 4,927,198 | A | 5/1990 | Fennell et al. | |
| 5,141,272 | A * | 8/1992 | Veillette | E05B 65/0888 292/277 |
| 5,437,486 | A | 8/1995 | Hoffman | |
| 6,607,221 | B1 * | 8/2003 | Elliott | E05B 65/0876 292/33 |
| 7,537,251 | B1 | 5/2009 | Profita | |
| 9,234,724 | B2 * | 1/2016 | Spransy | E05G 5/003 |

* cited by examiner

*Primary Examiner* — Kristina R Fulton
*Assistant Examiner* — Thomas L Neubauer
(74) *Attorney, Agent, or Firm* — Armstrong Teasdale LLP

(57) ABSTRACT

A method and an adjustable locking system for sliding windows and/or sliding doors are provided. The adjustable locking system includes a slide rail, a jammer bar, and a sliding spring-loaded pull pin lock. The slide rail mounts flush to the action portion of the sliding window or sliding door frame. The spring loaded locking pin is attached to the jammer bar which slides through the slide rail; engaging in a series of optional locking points allowing the window or door to be securely locked anywhere in between fully open to fully closed.

4 Claims, 6 Drawing Sheets

METHOD AND SYSTEM FOR ADJUSTABLE SAFETY LOCKS

BACKGROUND

The field of the disclosure relates generally to window and door security and, more particularly, to locking systems for vertical and horizontal sliding windows and sliding doors at varying positions ranging from fully open to fully closed.

Currently sliding windows (both vertically and horizontally) and sliding doors are manufactured to have locking mechanisms in the fully closed position. The problem is when the window or door is partially open allowing for a breeze to enter, the built in locking mechanism offers no security after the window or door is partially or fully open. Other adjustable locking systems for partially open sliding windows or doors have been described. Examples include Profita U.S. Pat. No. 7,537,251 (2009), Hoffman U.S. Pat. No. 5,437,486 (1995), and Fennell U.S. Pat. No. 4,927,198 (1990). The problem with these other inventions include difficult installation, requiring the use of tools for installation, and spring loaded push pin locking mechanisms are difficult for children, the handicapped and the elderly to operate.

BRIEF DESCRIPTION

In one aspect, an adjustable locking system includes a slide rail, a jammer bar, and a sliding spring-loaded pull pin lock. The slide rail mounts flush to the action portion of the sliding window or sliding door frame. The spring loaded locking pin is attached to the jammer bar which slides through the slide rail; engaging in a series of optional locking points allowing the window or door to be securely locked anywhere in between fully open to fully closed.

BRIEF DESCRIPTION OF THE DRAWINGS

FIG. 1 is an embodiment depicting the method of the present invention in relation to a completely closed vertical sliding window environment.

FIG. 2 is an embodiment depicting the method of the present invention in relation to a partially opened vertical sliding window environment.

FIG. 3 is an embodiment depicting the method of the present invention in relation to a completely opened vertical sliding window environment.

FIG. 4 is an embodiment depicting the method of the present invention in relation to a completely closed horizontal sliding window environment.

FIG. 5 is an embodiment depicting the method of the present invention in relation to a partially opened horizontal sliding window environment.

FIG. 6 is an embodiment depicting the method of the present invention in relation to a completely opened horizontal sliding window environment.

FIG. 7 is an embodiment depicting the method of the present invention in relation to a completely closed sliding door environment.

FIG. 8 is an embodiment depicting the method of the present invention in relation to a partially opened sliding door environment.

FIG. 9 is an embodiment depicting the method of the present invention in relation to a completely opened sliding door environment.

FIGS. 10-17 show example embodiments of the method and apparatus described herein depicting internal parts and mechanical functions.

FIG. 10 is an embodiment depicting a side view of the present invention in a non-action position.

FIG. 11 is an embodiment depicting a topside view of the present invention in a non-action position.

FIG. 12 is an embodiment depicting a back to front view, looking from end to end through the length of the part known as the slide rail.

FIG. 13 is an embodiment depicting a front to back view of the spring loaded locking assembly.

FIG. 14 is an embodiment depicting a side view of the spring loaded locking assembly.

FIG. 15 is an embodiment depicting a topside view of the part known as the slide rail; this view illustrates the multitude of optional locking positions of the present invention as it relates to its functionality.

FIG. 16 is an embodiment depicting a side view of the present invention in a non-action position; the embodiment cutout is to illustrate how the apparatus appears when fully assembled.

FIG. 17 is an embodiment depicting a side view of the present invention in an actuated position; the embodiment cutout is to illustrate how the apparatus appears when fully assembled in a midway locked position.

Figure 1:
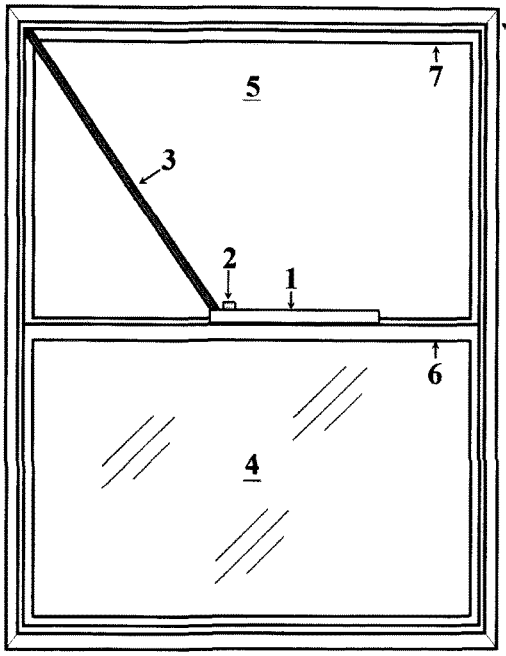
FIGS. 1-17 show example embodiments of the method and apparatus described herein as it functions with its environment.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to reasonably secure and/or lock either sliding windows and/or sliding doors in variable positions ranging from completely closed to completely open and anywhere in between thus allowing for the window or door environment to be partially open yet reasonably secured.

Embodiments of an adjustable safety lock system for sliding windows, specifically for windows that slide open either by sliding vertically or horizontally and includes standard sliding doors are provided herein. The adjustable safety lock system attaches to the inside of the frame of the sliding portion of either the window or the door. The side of the frame that this invention attaches to would be considered the inside of the dwelling or the living area side of the said window or door.

The first objective of the adjustable safety lock system is to allow for a sliding window or sliding door to be partially opened, while still providing a reasonable level of security. The second objective of the adjustable safety lock system is to provide a product that is easily operated by children, the handicapped and the elderly. The third and final objective of the adjustable safety lock system is to provide an aesthetically pleasing product that offers a no tools required installation.

The adjustable safety lock system includes three main pieces, the slide rail which attaches to the window or door frame, the sliding spring-loaded pull pin lock that in seated inside of the slide rail, and the jammer bar that is attached to the sliding spring-loaded pull pin lock.

Out of the box, the adjustable safety lock system comes fully assembled with a piece of commercial grade adhesive strip on the bottom of the slide rail. When the user is ready to install the adjustable safety lock system, they will first locate the cleansing pad inside each box and clean the area free of wax, dirt and debris of the window or door frame they wish to adhere the slide rail to. Next they will do a test run installation, by simply holding the adjustable safety lock system in the designated installation area they wish to install it, just to make sure there is nothing in the way for final installation. When the area is clean, dry and they have checked to make sure the area is free from distraction, they simply tear off the adhesive strip protection layer and stick the adjustable safety lock system to the designated installation area. The adjustable safety lock system is ready to use.

The adjustable safety lock system works by way of a brace against the corner of the window frame and the slide rail, like that of a bicycle kick stand; creating a triangle shaped wedge for protection against forced unwarranted entry. The adjustable safety lock system has adjustable locking positions in increments ranging from fully locked, which is the window completely closed; to the window being completely open and everywhere in between at the variable locking positions. The locking action is the result of a spring loaded pull pin. The user lifts on the adjuster knob which pulls the pull pin free of the current locking position hole; the user then slides the seated locking pin to the desired locking position and releases the spring loaded locking pin; which then engages into that locked position.

The following description refers to the accompanying drawings, in which, in the absence of a contrary representation, the same numbers in different drawings represent similar elements.

Figure 2:
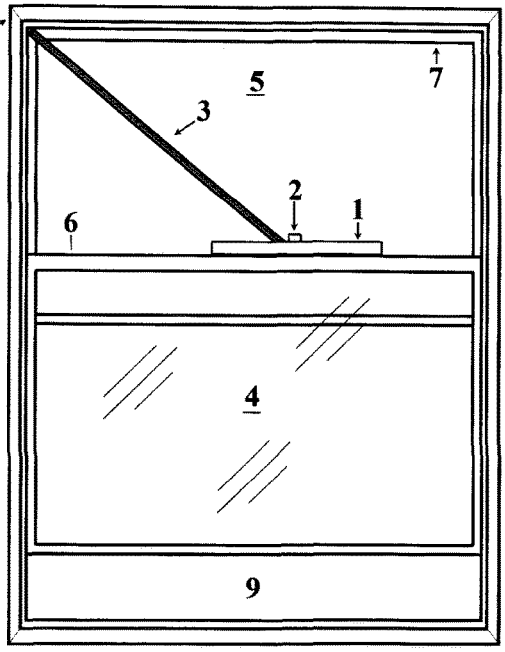

FIG. 1 is a front elevation view of a vertically sliding window with an adjustable safety lock system installed. As shown in FIG. 1 is the slide rail 1 in which the sliding spring-loaded pull pin lock assembly 2 slides inside of. The jammer bar 3 which is the wedge that provides the resistance for security; it is attached to the sliding spring loaded pull pin assembly 2 via a pin 16 that slides through the front end of the slide 15; which is part of the sliding spring-loaded pull pin lock assembly 2; that slides in the slide grooves 13; which all slides together inside of the FIG. 12 Slide Rail 1. FIG. 2 shows the sliding action side of a conventional sliding window assembly 4. FIG. 2 shows the stationary non-action pane of glass in a conventional sliding window assembly 5.

Figure 3:
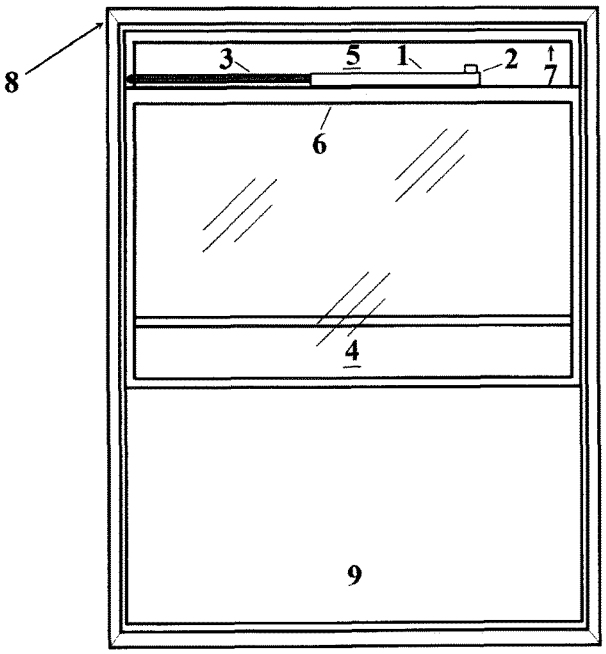
Figure 7:
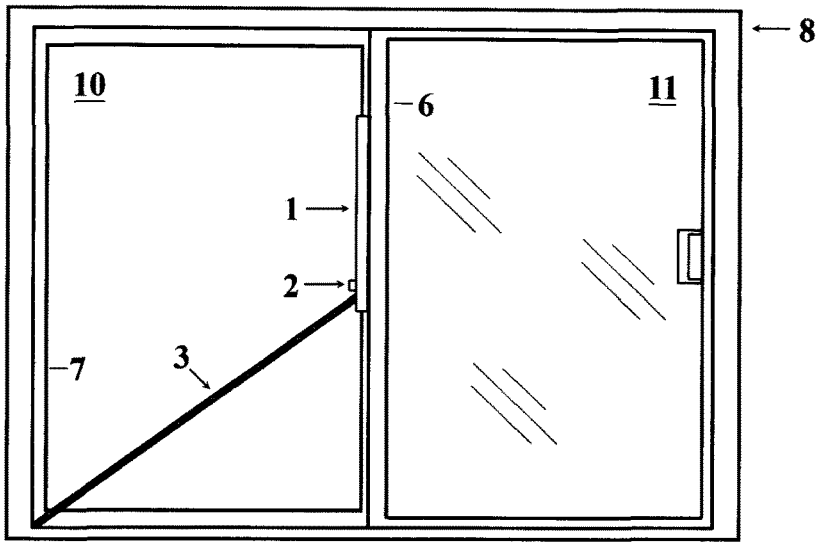

FIG. 1 shows the inner frame 6 of the sliding action pane of glass 4 in a conventional sliding window assembly; of which the fully assembled slide rail 1 assembly attaches to. FIG. 1 shows the inner window frame 7 of the fixed, non-moving portion 5 of a conventional window frame. FIG. 1 shows the outer most window frame 7 that is installed structurally in a building. FIG. 3 shows the open portion 9 of a sliding window or sliding door, also known as the airway, allowing breeze to flow through the opening of the window. FIG. 7 shows the fixed, non-moving portion of a sliding door 10, this is the side of the door that is permanently secured within the outer doorframe 8. FIG. 7 shows the sliding action side 11 of a conventional sliding door assembly, also known as the door side of the sliding door assembly; of which the fully assembled slide rail assembly 1 attaches to.

Figure 10:
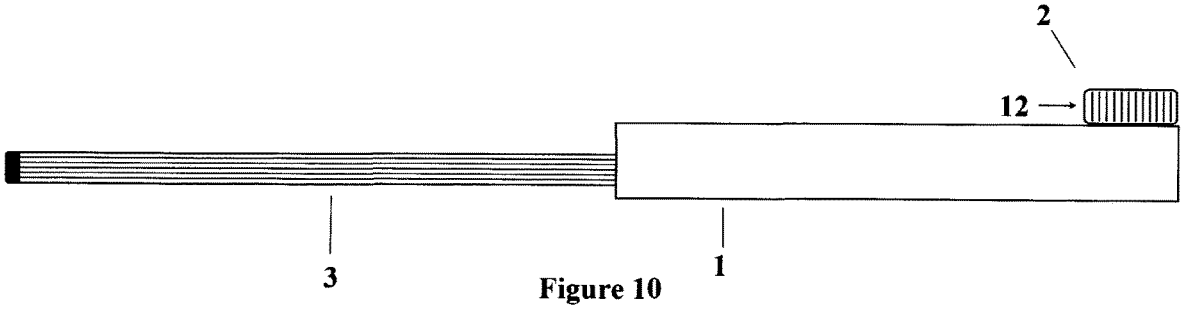

FIG. 10 shows the knob 12 of the Sliding Spring-Loaded Pull Pin Lock 2. In various embodiments, adjust knob 12 is approximately one inch in diameter, approximately three-quarters inches tall, has grip grooves on the side for easy finger gripping and is meant to be easily grasped by weak or arthritic hands; these measurements are in no way meant to define the size of the pull knob 12 on the final application; the example was merely used to give a common visual aid for point of reference. The knob 12 that is responsible for pulling the locking pin 18 on the bottom of the sliding spring-loaded pull pin lock 2; thus allowing the slide 15 to release from the lock pin holes 14 where the sliding spring-loaded pull pin lock 18 seats.

Figure 12:
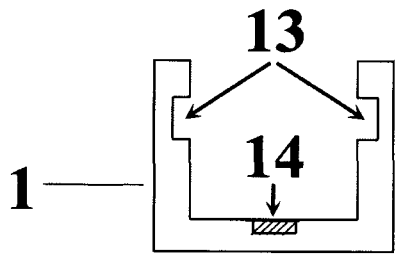

FIG. 12 shows the end to end-through view of the slide rail 1. The slide rail 1 is a U shaped channel in which the Sliding Spring-Loaded Pull Pin Lock assembly 2 is located. The slide rail 1 has an infinite length depending on the scale of the application. The slide rail 1 is just the vessel in which the locking mechanism is housed and can be any length. The slide rail 1 has two groves in the sides of the channel referred to as the slide grooves 13. These slide groves 13 are what holds the slide 15 in place. These slide grooves 13 run the entire length of the slide rail 1, thus allowing the Sliding Spring-Loaded Pull Pin Lock assembly 2 to slide freely from one end of the slide rail 1 to the other end. The slide rail 1 also has the lock pin holes 14 where the Sliding Spring-Loaded Pull Pin Lock 18 seats; also illustrated as the optional locking pin holes 17 along the inside bottom of the Slide Rail 1; these holes are in the bottom of the slide rail 1 channel FIG. 15 at intervals across the entire length of the slide rail 1. The lock pin holes 14 are what securely hold the locking pin 18 on the bottom of the Sliding Spring-Loaded Pull Pin Lock assembly 2; thus holding the Sliding Spring-Loaded Pull Pin Lock assembly 2 in the desired position within the optional locking pin holes 17 along the inside bottom of the Slide Rail 1; which gives the support for the jammer bar 3 which is the wedge that provides the resistance for security.

Figure 13:
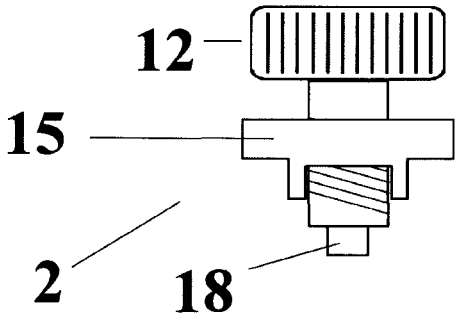

FIG. 13 shows the front view of the slide 15. The slide 15 is the steady center to this invention; holding everything in place; as it nearly touches and controls every other part of this locking mechanism system. The slide 15 is perfectly measured to securely seat inside the slide grooves 13 cut inside the sides of the Slide Rail 1. The slide 15 also secures the locking pin 18 on the bottom of the slide rail 2 into the optional locking pin holes 17. The slide 15 also has a hole in the front as seen in FIG. 14.

Figure 14:
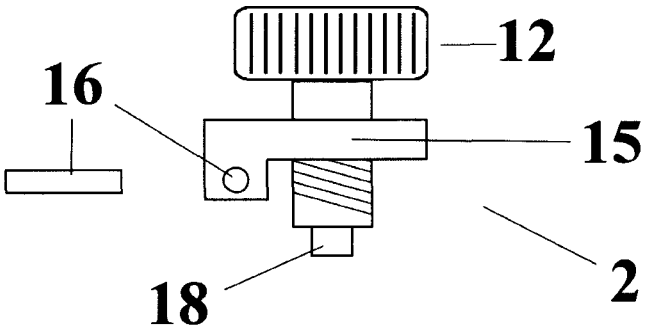

FIG. 14 shows the hole where the pin 16 is located that attaches the Jammer Bar 3 to the slide 15. The Jammer Bar 3 is the security mechanism that physically secures the sliding portion of either the sliding window 6 or sliding door 11; providing reasonable protection against forced unwarranted entry. The jammer bar 3 can also be a variable length to be determined by the size of the application. Whatever the size of the open portion of a sliding window 9 or sliding door 11, also known as the airway, allowing breeze to flow through the opening of the window; determines the length of the jammer bar 3.

During operation as shown in FIG. 1 the slide rail 1 is attached to the inner frame 6 of the sliding action 4 of a conventional sliding window/door assembly. The Jammer Bar 3 is the security mechanism that physically secures the sliding portion of either the sliding window or sliding door; providing reasonable protection against forced unwarranted entry by means of physical resistance not allowing the window/door to open any further than the current locked position. The sliding spring-loaded pull pin lock assembly 2 that slides inside of the slide rail 1 is the means for selecting the current locked position. When the user desires to either further open the open portion of a sliding window 4 or sliding door 11, also known as the airway, or close the open portion 9; they simply pull up on the adjustment knob 12 of the Sliding Spring-Loaded Pull Pin Lock assembly 2; freeing the locking pin 18 from the bottom of the Sliding Spring-Loaded Pull Pin Lock assembly 2; releasing it from the lock pin holes 14 where the Sliding Spring-Loaded Pull Pin Lock 18 seats; allowing the slide 15, to slide along the slide grooves 13 cut inside the sides of the Slide Rail 1; relocating the locking pin 18 on the bottom of the Sliding Spring-Loaded Pull Pin Lock 2; to the desired optional locking pin holes 17 along the inside bottom of the Slide Rail 1; then releasing the adjustment knob 12 of the Sliding Spring-Loaded Pull Pin Lock assembly 2; thus returning the locking pin 18 on the bottom of the Sliding Spring-Loaded Pull Pin Lock 2; into the lock pin holes 14 where the locking pin 18 seats; in turn creating a new locked position such as illustrated in FIG. 2.

FIG. 1 shows the adjustable safety lock system 1, 2, 3 installed on the inner window frame of the sliding portion of the window 6. In FIG. 1 the window is in the completely closed locked position 4. The adjustable safety lock system is in the fully closed locked position.

FIG. 2 shows the adjustable safety lock system 1, 2, 3 installed on the inner window frame of the sliding portion of the window 6. The window is in the partially open position 4; allowing for a breeze to enter 9. The adjustable safety lock system is in the partially open locked position FIG. 17.

FIG. 3 shows the adjustable safety lock system 1, 2, 3 installed on the inner window frame of the sliding portion of the window 6. The window is in the completely open position 9; not allowing for any measure of security. The adjustable safety lock system is in the fully unlocked position.

Figure 4:
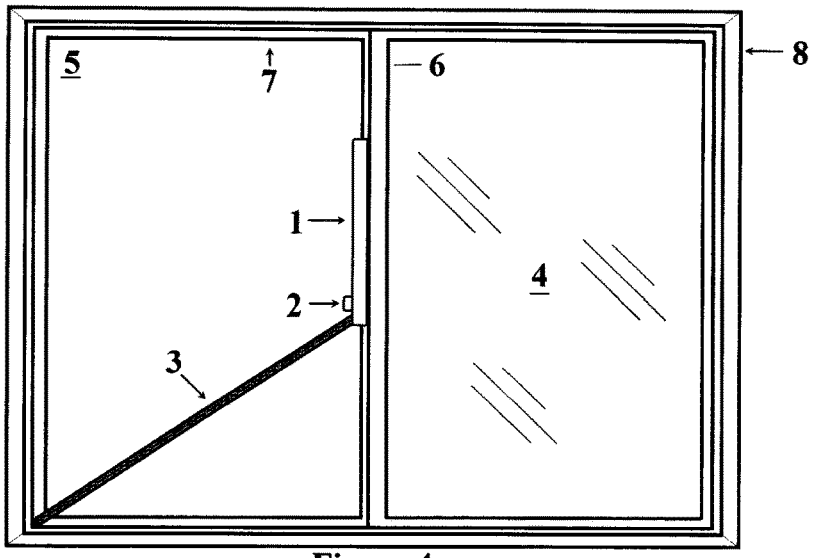

FIG. 4 shows the adjustable safety lock system 1, 2, 3 installed on the inner window frame of the sliding portion of the window 6. The window is in the completely closed locked position 4. The adjustable safety lock system is in the fully closed locked position.

Figure 5:
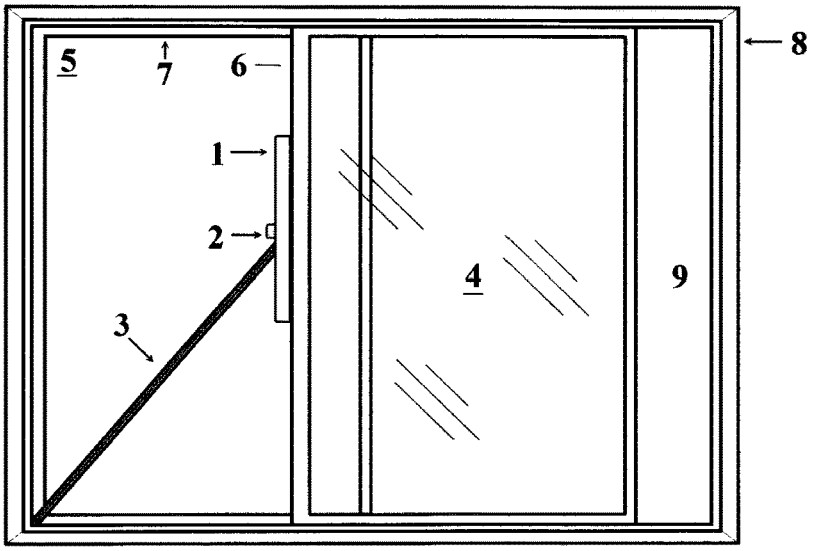

FIG. 5 shows the adjustable safety lock system 1, 2, 3 installed on the inner window frame of the sliding portion of the window 6. The window is in the partially open position; allowing for a breeze to enter 9. The adjustable safety lock system is in the partially open locked position FIG. 17.

Figure 6:
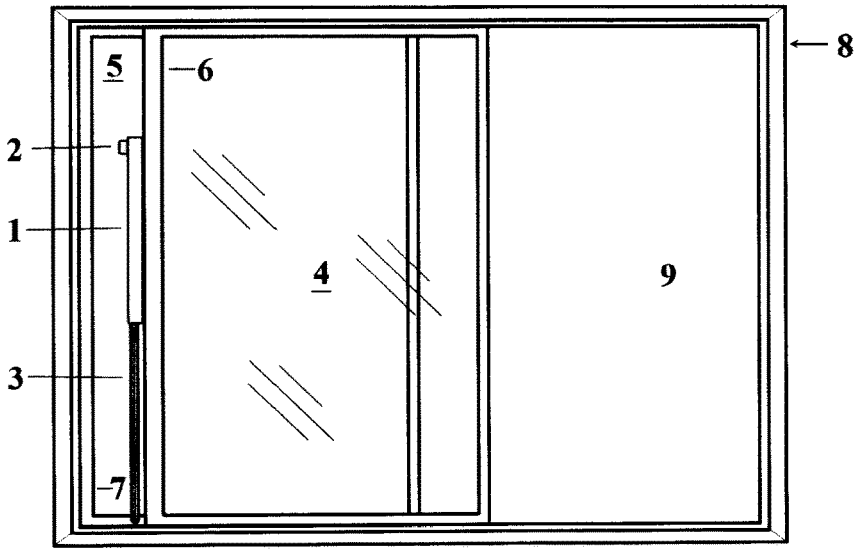

FIG. 6 shows the adjustable safety lock system 1, 2, 3 installed on the inner window frame of the sliding portion of the window 6. The window is in the completely open position; not allowing for any measure of security 9. The adjustable safety lock system is in the fully unlocked position.

FIG. 7 shows the adjustable safety lock system 1, 2, 3 installed on the sliding portion of the door 11. The sliding door is in the completely closed locked position. The adjustable safety lock system is in the fully closed locked position.

Figure 8:
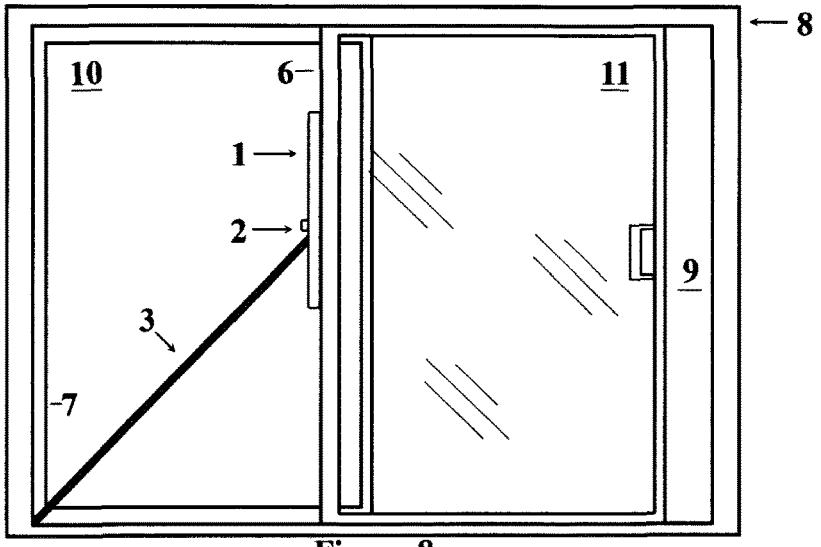

FIG. 8 shows the adjustable safety lock system 1, 2, 3 installed on the sliding portion of the door 11. The sliding door is in the partially open position; allowing for a breeze to enter. The adjustable safety lock system is in the partially open locked position.

Figure 9:
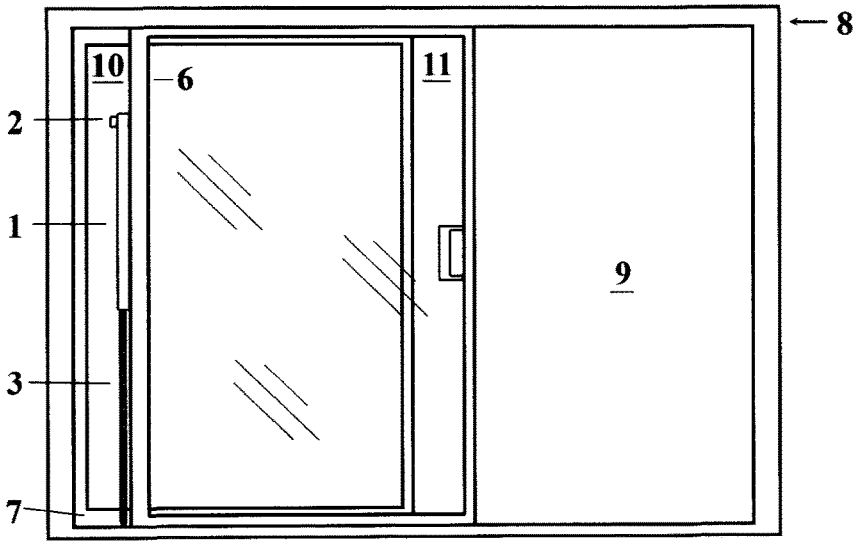

FIG. 9 shows the adjustable safety lock system 1, 2, 3 installed on the sliding portion of the door 11. The sliding door is in the completely open position; not allowing for any measure of security. The adjustable safety lock system is in the fully unlocked position.

FIG. 10 is a side view of the Adjustable safety lock system in the fully unlocked position and features knob of the Sliding Spring-Loaded Pull Pin Lock 12 used to adjust the sliding locking pin FIG. 13.

Figure 11:
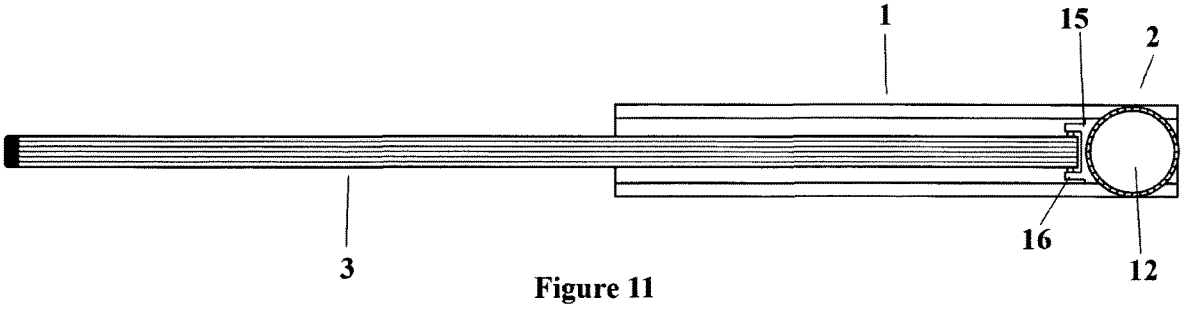

FIG. 11 is a top view of the Adjustable safety lock system in the fully unlocked position.

FIG. 12 is a back to front view of the slide rail, looking from end to end through the slide rail. This view displays the slide grooves cut inside the Slide Rail 13 where the slide, that puts the slide in the Sliding Spring-Loaded Pull Pin Lock 15 seats. This figure also shows the lock pin holes where the Sliding Spring-Loaded Pull Pin Lock seats 14.

FIG. 13 is a front view of the spring loaded locking pin assembly. From this view you can see how the spring loaded locking pin assembly fits into the slide rail FIG. 12. This view also features the slide that puts the slide in the Sliding Spring-Loaded Pull Pin Lock 15.

FIG. 14 is a side view of the spring loaded locking pin assembly. This view identifies the locking pin on the bottom of the Sliding Spring-Loaded Pull Pin Lock 18

Figure 15:
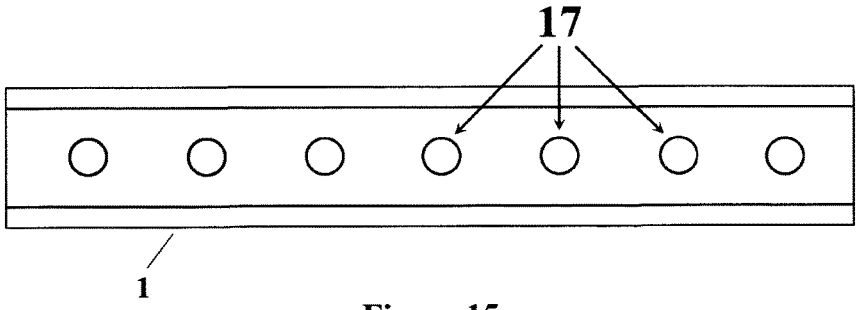

FIG. 15 is a top view of the slide rail without the spring loaded locking pin assembly in place. This view show the optional locking pin holes along the inside bottom of the Slide Rail 17

Figure 16:
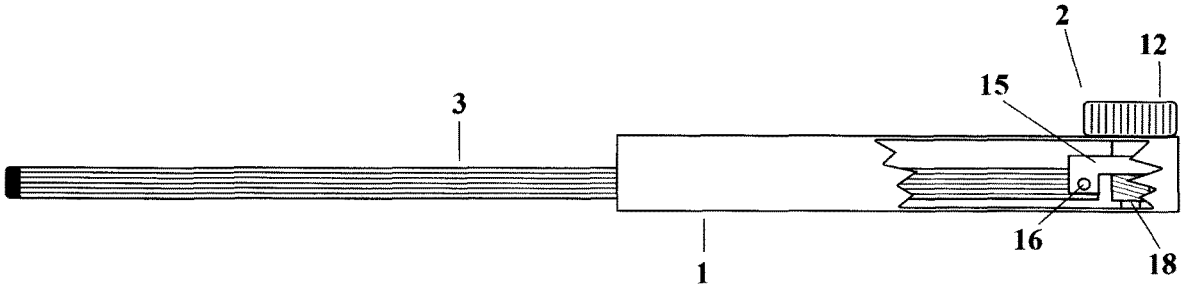

FIG. 16 is a side view of the Adjustable safety lock system in the fully unlocked position. This cutout view shows the internal parts fully assembled inside the slide rail.

Figure 17:
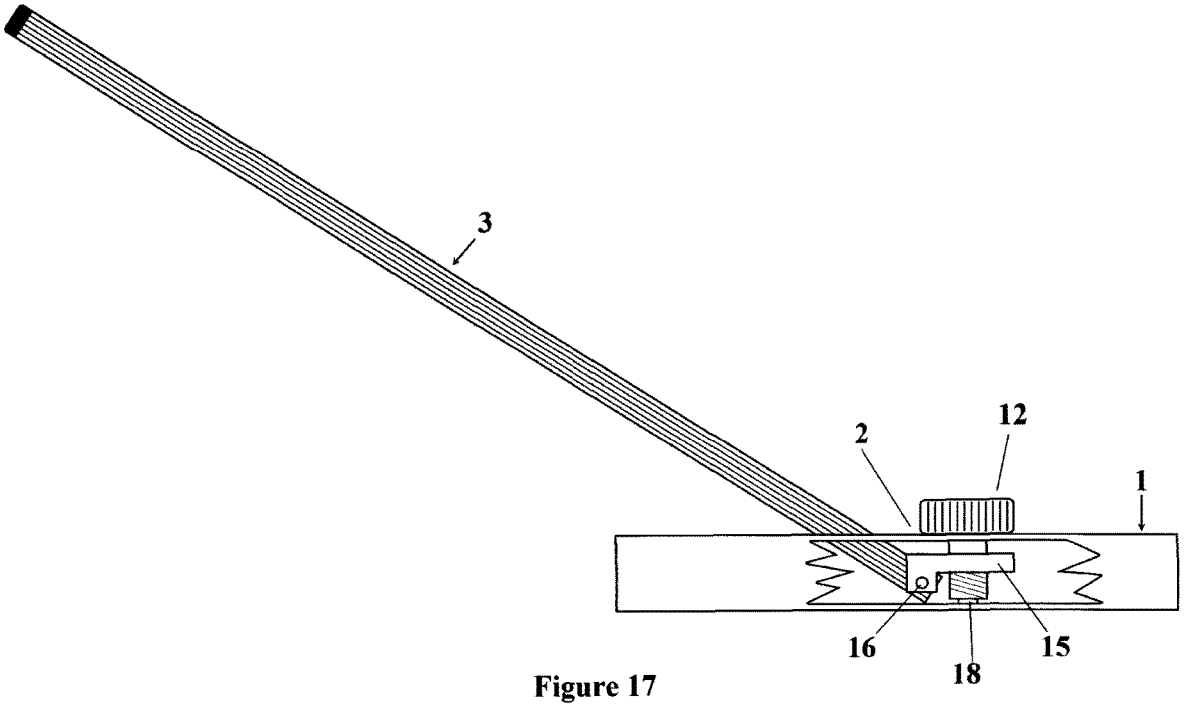

FIG. 17 is a side view of the adjustable safety lock system is in the partially open locked position. This cutout view shows the internal parts fully assembled inside the slide rail. This view also points out the adjustable safety lock system parts 1, 2, 3.

The above-described sliding panel locking systems provides an efficient method for reasonable protection against forced unwarranted entry. Specifically, the above-described adjustable safety lock system includes a slide rail which attaches to the window or door frame, the sliding spring-loaded pull pin lock that in seated inside of the slide rail, and the jammer bar that is attached to the sliding spring-loaded pull pin lock.

It will be understood by those of ordinary skill in the art that while it is shown that the sliding door lock utilizes square tubing and/or channels, the tubing and/or channel shapes are not limited to a square in cross-section. Any cross-sectional tube and/or channel may be utilized, including, but not limited to a triangle, a circle, a rectangle, and any other rectilinear shape.

The components defining any embodiment of a sliding door lock in accordance with the present invention may be formed of any of many different types of materials or combinations thereof that can readily be formed into shaped objects provided that the components selected are consistent with the intended operation of a sliding door lock. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as Zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of a sliding door lock in accordance With the present invention may be purchased pre-manufactured or manufactured separately and then assembled together. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, Welding, soldering, hardening, riveting, punching, plating, and/or the like. If any of the components are manufactured separately, they may then be coupled With one another in any manner, such as With adhesive, a Weld, a fastener (e.g. a bolt, a nut, a screw, a nail, a rivet, a pin, and/or the like), Wiring, any combination thereof, and/or the like for example, depending on, among other considerations, the particular material forming the components. Other possible steps might include sandblasting, polishing, powder coating, zinc plating, anodizing, hard anodizing, and/or painting the components for example.

While it has been shown that the sliding door lock is used with sliding doors, it may be used on other structures. For example and without limitation, embodiments of the present invention may be used with sliding windows.

The embodiments and examples set forth herein were presented in order to best explain the present invention and its practical application and to there by enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The above-described sliding panel locking systems provides an efficient method for reasonable protection against forced unwarranted entry. Specifically, the above-described adjustable safety lock system includes a slide rail which attaches to the window or door frame, the sliding spring-loaded pull pin lock that in seated inside of the slide rail, and the jammer bar that is attached to the sliding spring-loaded pull pin lock.

The above-described embodiments of a method and system of an adjustable safety lock system provide a cost-effective and reliable means for providing reasonable protection against forced unwarranted entry of a sliding window or sliding door in a fully open, fully closed, or intermediate position. More specifically, the methods and systems described herein facilitate locking a sliding door or window in an intermediate position between a fully open position and a fully closed position. As a result, the methods and systems described herein facilitate comfort and security in a dwelling simultaneously in a cost-effective and reliable manner.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An adjustable safety lock system for use with a sliding door or sliding window within a frame, said lock system comprising:

a slide rail having a U-shaped cross-section, each side of the slide rail comprising a slide groove extending along a length of said slide rail, said slide rail further comprising a plurality of lock pin holes spaced along a bottom of the slide rail the length of said slide rail;

a sliding spring-loaded pull pin lock seated in both slide grooves inside of the slide rail and configured to engage any of a plurality of selectable lock positions spaced along a length of the slide rail when the adjustable safety lock system is deployed; and a unitary jammer bar comprising:

a first end pivotally coupled to the sliding spring-loaded pull pin lock through a pinned connection; and a second distal end forming a brace oriented to seat against a corner of one of the sliding door and the sliding window or the frame to securely lock the sliding door or sliding window at any selected position between and including the fully open and fully closed positions, wherein movement of the sliding door or sliding window towards the fully open position forces the brace against the corner and the sliding door or sliding window is prevented from opening any further than the selected position and movement of the sliding door or sliding window towards the fully closed position is permitted.

2. A method of operating an adjustable safety lock system for a sliding window or a sliding door slidable within a frame, said method comprising:

operating a lock pin to disengage a slide member from locking engagement with a slide channel fixedly coupled to a movable portion of the sliding window or sliding door;

sliding the slide member in the slide channel from a first position with respect to the slide channel simultaneous with moving the sliding window or the sliding door along a track; and securely locking the sliding window or the sliding door at any selected position between and including the fully open and fully closed positions by:

bracing a first end of a jammer bar against a corner of the frame of the sliding window or sliding door;

pivotally coupling a second end of the jammer bar to the slide member;

engaging the lock pin to the slide channel to secure the slide member in a second position with respect to the slide channel; and moving the sliding window or the sliding door towards the fully open direction without disengaging the slide member from locking engagement with the slide channel such that the first end of the jammer bar is forced against the corner such that the sliding window or sliding door may only open to the selected position, and wherein selectively moving the sliding window or the sliding door from the selected position towards the fully closed position without disengaging the slide member from the locking engagement with the slide channel is permitted.

3. An adjustable sliding door or window safety lock system comprising:

a sliding window or sliding door assembly comprising:

a frame comprising an inner frame;

a sliding portion of said sliding door or window assembly slidably engaged to said inner frame and selectively moveable between a fully open position and a fully closed position;

a slide rail fixedly coupled to said sliding portion;

a sliding spring-loaded pull pin lock seated inside of the slide rail and configured to engage any of a plurality of selectable lock positions spaced along a length of the slide rail; and a jammer bar comprising:

a first end coupled to the sliding spring-loaded pull pin lock; and a second distal end forming a brace oriented to seat against a corner of said inner frame to prevent movement of the sliding portion of the sliding window or sliding door assembly in an open direction when the sliding window or door assembly is securely locked at any selected position between the fully open and fully closed positions wherein movement of the sliding door or sliding window assembly towards the fully open position forces the brace against the corner such that the sliding door or window is prevented from opening any further than the selected position and movement of the sliding window or sliding door assembly towards the fully closed position is permitted.

4. The adjustable sliding door or window safety lock system of claim 3, wherein the sliding window or door assembly comprises the sliding portion and a fixed portion of the sliding door or window assembly slidably engaged to the inner frame.

* * * * *